United States Patent [19]

Colby

[11] 4,120,103

[45] Oct. 17, 1978

[54] DISPOSABLE BOWLING SHOE

[76] Inventor: Robert D. Colby, 280 W. State St., Montrose, Mich. 48457

[21] Appl. No.: 835,778

[22] Filed: Sep. 22, 1977

[51] Int. Cl.[2] ..... A43B 3/26; A43B 5/00

[52] U.S. Cl. ..... 36/97; 36/130

[58] Field of Search ..... 36/97, 130

[56] References Cited

U.S. PATENT DOCUMENTS

| | | | |
|---|---|---|---|
| 2,009,684 | 7/1935 | Affronte | 36/97 |
| 2,734,284 | 2/1956 | Seurbon | 36/97 |
| 2,745,196 | 5/1956 | Schneider et al. | 36/97 |

*Primary Examiner*—Patrick D. Lawson

[57] ABSTRACT

This shoe consists primarily of a toe portion, a heel portion, and an adjustable arch, which, when the shoe is assembled, will be held in place by pointed plastic tabs on inner sole portions, when pressure is applied. The shoe further includes toothed tongues of the heel portion, which are received in toothed pockets in the toe portion, and strap means on the heel portion provides fastening means to the toe portion by buckles thereon.

3 Claims, 10 Drawing Figures

FIG. 1
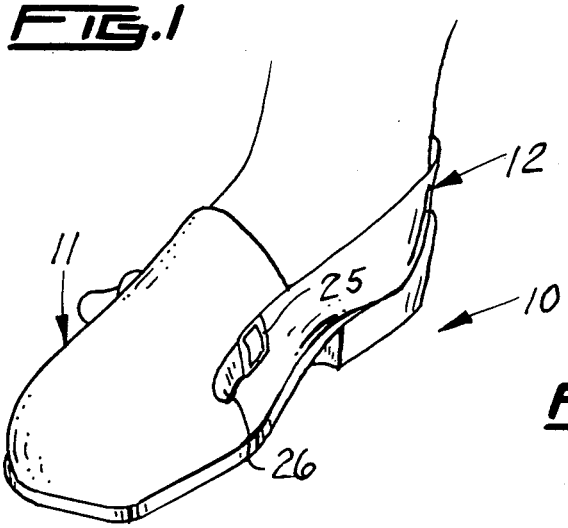
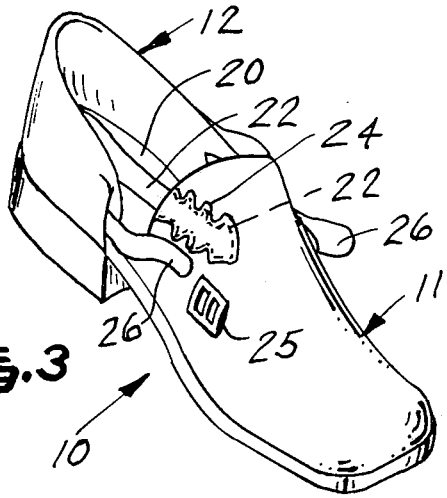
FIG. 3
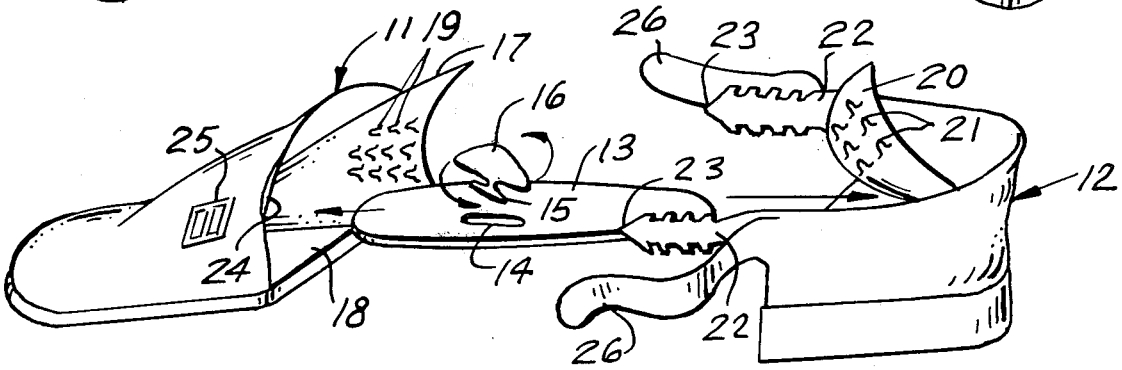
FIG. 2
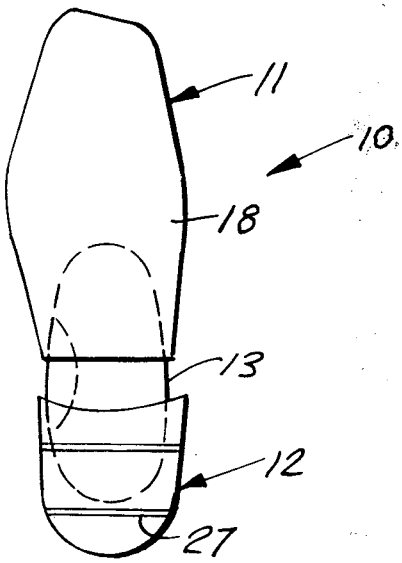
FIG. 4
FIG. 5
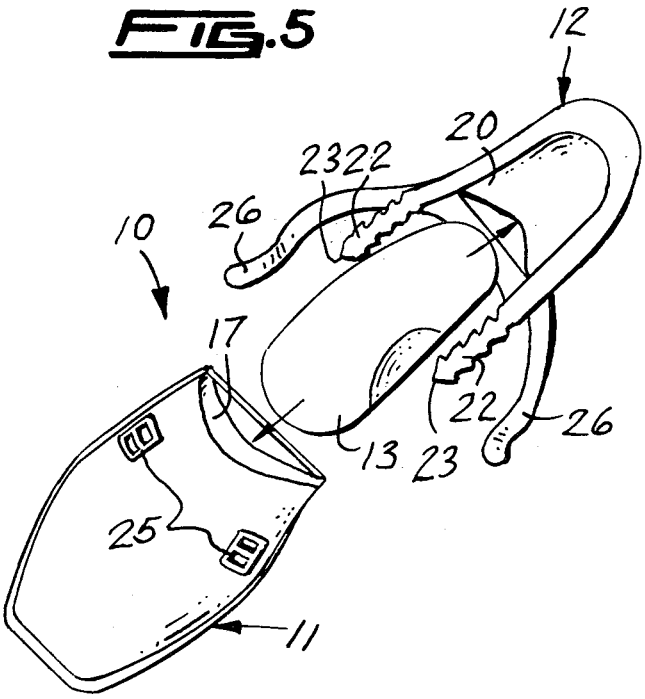

DISPOSABLE BOWLING SHOE

This invention relates to foot-gear, and more particularly to a disposable bowling shoe.

It is, therefore, the principal object of this invention to provide a disposable bowling shoe, which will have adjustable arch means, and will be adjustable in size, to accommodate the foot sizes of all people.

Another object of this invention is to provide a disposable bowling shoe, which will have built-in means for holding the components together, after the arch, toe portion and heel portions are adjusted for the wearer's foot size.

A further object of this invention is to provide a disposable bowling shoe, of the type described, which will have a non-slip heel and sole.

Other objects of this invention are to provide a disposable bowling shoe, which is simple in design, inexpensive to manufacture, rugged in construction, and comfortable to wear.

These, and other objects, will be readily evident, upon a study of the following specification and the accompanying drawings, wherein:

FIG. 1 is a perspective view of the present invention, shown in use;

FIG. 2 is an exploded perspective view of FIG. 1;

FIG. 3 is a perspective view, showing the straps released;

FIG. 4 is a bottom plan view of FIG. 1;

FIG. 5 is an exploded plan view of the invention, showing the adjustable arch;

Figure 6:
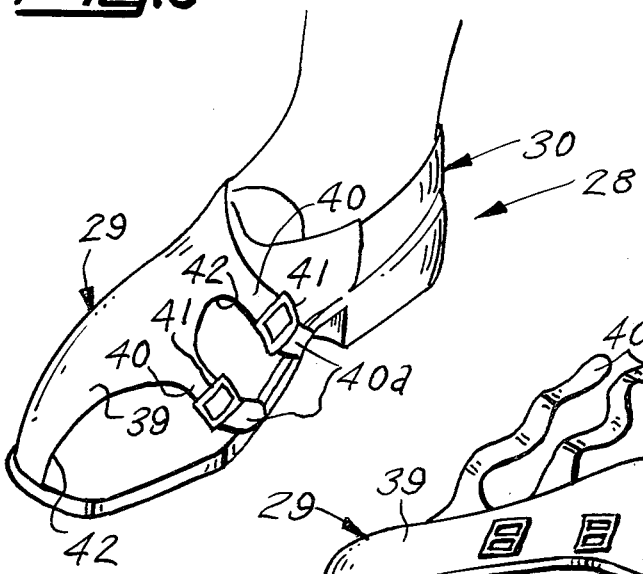
FIG. 6 is a perspective view of a modified form of the invention.

According to this invention, a disposable bowling shoe 10 is shown to include a toe portion 11 and a heel portion 12, which together will receive an adjustable arch support 13. An elongated slot 14, in arch support 13, receives the tongue 15 of tab 16. The top is an adjustable arch member so as to fit all sizes of feet. An inner sole 17 is hinged, in a suitable manner, to one side of sole 18, on the interior of the toe portion 11. Inner sole 17 is provided with a plurality of spaced-apart, plastic and pointed tabs 19, for a purpose which hereinafter will be described. Heel portion 12 includes an inner sole 20, having pointed tabs 21, and is secured at one side, in the same manner as heretofore described of inner sole 17.

The tabs 19 and 21 will pierce the arch support 13, when inner sole 17 and 20 are folded down upon the arch 13, and the user steps down, thus rendering toe portion 11, arch support 13, and heel portion 12 stationary with each other.

Toothed tongues 22, having pointed ends 23, extends from each side of the heel portion 12, and are urged into the toothed pocket openings 24 of toe portion 11, and the combination of tabs 19, tabs 21 and the toothed tongues 22, serve as adjustment means for shoe 10, so as to adapt it to any size foot.

The toe portion 11 is provided with a pair of externally secured buckles 25, for receiving the straps 26, extending from the heel portion 12. The bottom of heel portion 12 is provided with rubber strips 27, so as to prevent shoe 10 from slipping upon a surface.

Figure 7:
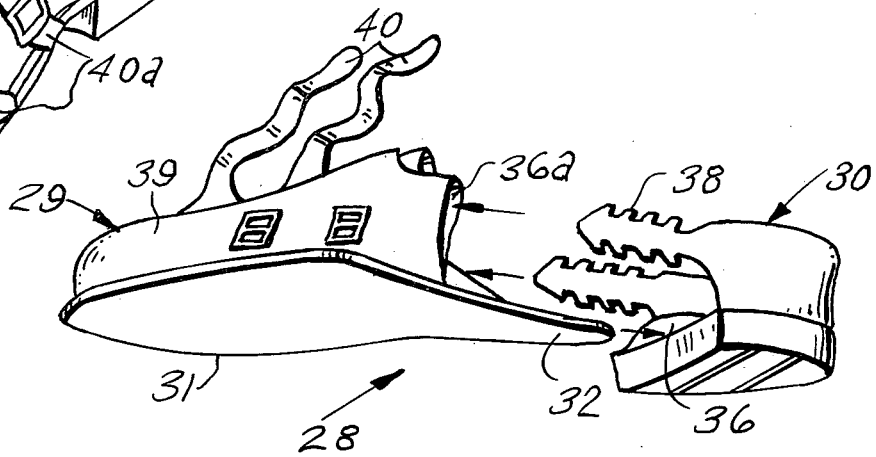
FIG. 7 is a partially exploded, perspective view of FIG. 6.
Figure 8:
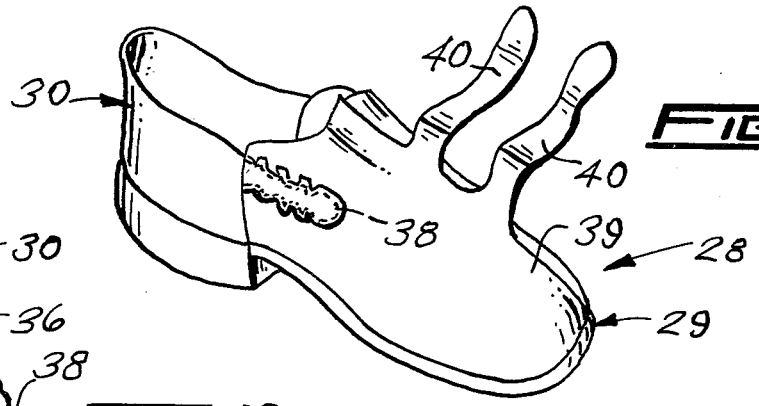
FIG. 8 is a perspective view of FIG. 6, showing the tie-down straps released.
Figure 10:
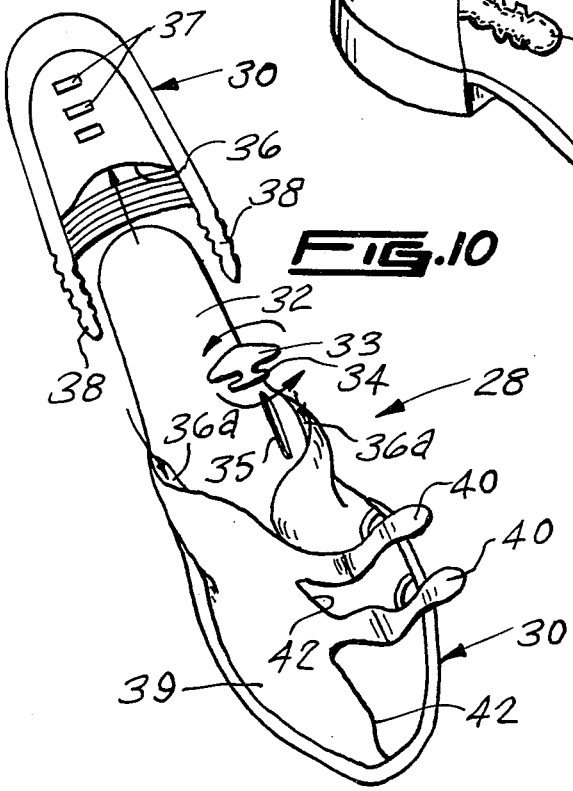
FIG. 10 is an exploded, top plan view of FIG. 6.
Figure 9:
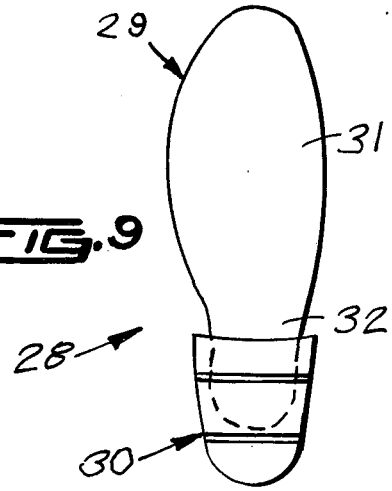
FIG. 9 is a bottom plan view of FIG. 6.

Referring now to FIGS. 6 through 10, a modified form of disposable bowling shoe 28 is shown to include a toe portion 29 and a heel portion 30. The portion 29 is provided with a sole 31, having an adjustable arch support 32. Arch support 32 includes a tab 33 on which a tongue 34 is received within slot 35. The arch support 32 is received within opening 36 of heel portion 30, and a plurality of spaced-apart strips of adhesive 37, within heel portion 30, provides a means of rendering the arch support 32 secure therein, when pressure is applied thereto.

A pair of toothed tongues 38, integral of heel portion 30, are received within pocket openings **36*a*, in a similar manner as heretofore described of shoe 10**.

Strip 39, whch is integral of toe portion 29, is provided with a pair of straps 40, which engage with buckles 41 of straps **40*a*, the combination defining a pair of openings 42**.

While various changes may be made in the detail construction, it is understood that such changes will be within the spirit and scope of the present invention, as is defined by the appended claims.

What I now claim is:

1. A disposable bowling shoe, comprising a toe portion with an inner sole secured at one longitudinal side edge, an adjustable arch support received within said toe portion, a heel portion, and an inner sole secured at one longitudinal side edge within said heel portion; said arch support including a tab having a T-shaped tongue, said tongue being received within and rotated within an elongated slot of said arch support, said tab comprising an adjustable arch member so to fit all sizes of feet, and when one end of said arch support is received within said toe portion and the other end is received within said heel portion beneath said inner soles of said toe portion and heel portion, said inner soles are folded downwards and the wearer, by applying pressure, with his foot, will cause a plurality of pointed and spaced-apart tabs of said inner sole to puncture the ends of said arch support, and thus render said arch support secure within said shoe.

2. The combination according to claim 1, wherein the upper portions at the front end of said heel portion of said shoe are provided with toothed tongues, each having a pointed end, said toothed tongues being inserted into toothed pockets integral with the open and rear portions of said toe portion of said shoe, the toothed portions providing a means of regulating the size of said shoe.

3. The combination according to claim 2, wherein a strap extends from said heel portion at each side and is parallel with said toothed tongues, said straps being received within buckles secured fixedly on the exterior of said toe portion.

* * * * *